US007874025B2

(12) United States Patent
Bowden et al.

(10) Patent No.: US 7,874,025 B2
(45) Date of Patent: Jan. 25, 2011

(54) GRAB BAR ASSEMBLY FOR SHOWER AND THE LIKE

(75) Inventors: Rohn Bowden, Greensboro, NC (US); Earl David Forrest, Asheboro, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 529 days.

(21) Appl. No.: 12/037,361

(22) Filed: Feb. 26, 2008

(65) Prior Publication Data

US 2009/0211017 A1 Aug. 27, 2009

(51) Int. Cl.
*A47K 3/12* (2006.01)

(52) U.S. Cl. ..... 4/576.1; 211/105.1; 248/251

(58) Field of Classification Search ..... 4/558, 4/576.1–577.1; 211/105.1–105.2, 123, 88.04; 248/251, 201, 220.21
See application file for complete search history.

(56) References Cited

U.S. PATENT DOCUMENTS

| | | | | |
|---|---|---|---|---|
| 1,944,478 | A * | 1/1934 | Tuckermann | 122/39 |
| 2,242,461 | A | 5/1941 | Fisher | |
| 2,388,637 | A | 11/1945 | John | |
| 4,754,504 | A * | 7/1988 | Cellini | 4/610 |
| 5,050,252 | A * | 9/1991 | Cuttriss | 4/576.1 |
| 5,577,275 | A | 11/1996 | Guenther | |
| 5,690,237 | A | 11/1997 | Marzec | |
| 6,038,714 | A | 3/2000 | Guenther | |
| 6,112,344 | A * | 9/2000 | Guenther | 4/576.1 |
| 6,199,808 | B1 * | 3/2001 | Lin | 248/222.14 |
| 6,381,769 | B1 | 5/2002 | Lofquist, Jr. | |
| 6,507,960 | B1 | 1/2003 | Kelly | |
| 6,651,830 | B2 * | 11/2003 | Pan | 211/105.1 |
| 6,796,442 | B1 * | 9/2004 | Wu | 211/105.1 |
| 7,124,451 | B2 | 10/2006 | Moore | |
| 2002/0074301 | A1 * | 6/2002 | Lai | 211/105.1 |

* cited by examiner

*Primary Examiner*—Charles Phillips
(74) *Attorney, Agent, or Firm*—Carlson, Gaskey & Olds, PC

(57) ABSTRACT

A grab bar assembly according to an exemplary aspect of the present invention includes: a grab bar having a first aperture and a second aperture defined along an axis; a post which receives the grab bar; an insert which pass through the first aperture and abut the second aperture; and a fastener mounted through the post and the second aperture along the axis, the fastener receivable into the insert to retain the grab bar within the post.

9 Claims, 1 Drawing Sheet

GRAB BAR ASSEMBLY FOR SHOWER AND THE LIKE

BACKGROUND

The present invention relates to a grab bar for use in a bath or shower, and more particularly to a grab bar which is readily assembled and installed.

Luxury showers and tubs are becoming increasing popular. Many hotels and motels install some sort of grab bar to provide a hand hold when for entrance and exit of the shower or tub.

Conventional support bars are typically constructed of a single piece of metal which has been bent to achieve a predetermined shape which cannot be modified to suit the application. While these bars work well, the bar must be mounted into studs or other strong support on the wall with a post. The secure attachment of the bar to the post may be relatively complicated and require additional components such as end caps.

SUMMARY

A grab bar assembly according to an exemplary aspect of the present invention includes: a grab bar having a first aperture and a second aperture defined along an axis; a post which receives the grab bar; an insert which pass through the first aperture and abut the second aperture; and a fastener mounted through the post and the second aperture along the axis, the fastener receivable into the insert to retain the grab bar within the post.

BRIEF DESCRIPTION OF THE DRAWINGS

The various features and advantages of this invention will become apparent to those skilled in the art from the following detailed description of the disclosed non-limiting embodiment. The drawings that accompany the detailed description can be briefly described as follows.

DETAILED DESCRIPTION OF THE EXEMPLARY EMBODIMENTS

Figure 1:
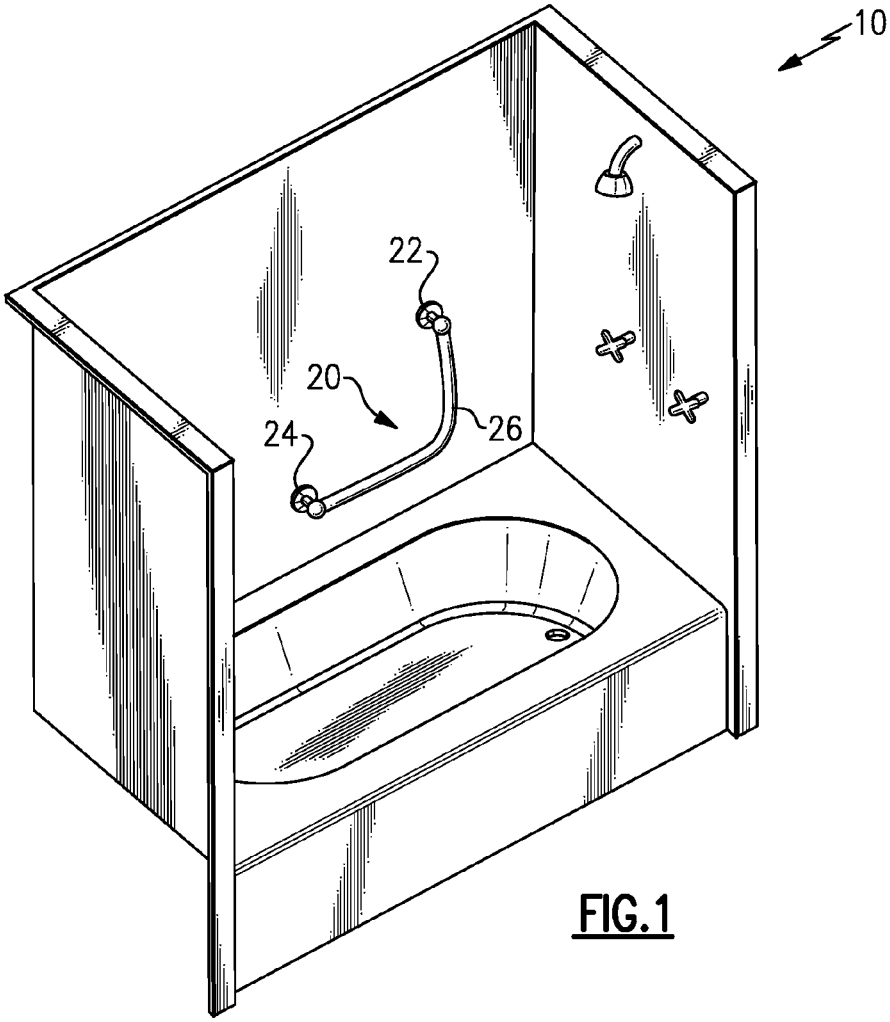
FIG. 1 is a general view a tub and shower surround having a grab bar assembly according to the present invention.

FIG. 1 schematically illustrates an exemplary tub or shower 10 with a grab bar assembly 20 of the present invention. The grab bar assembly 20 generally includes a first post assembly 22, a second post assembly 24, and a grab bar section 26 therebetween. As each post 22, 24 is essentially equivalent, only one need be describe in detail herein.

Figure 2:
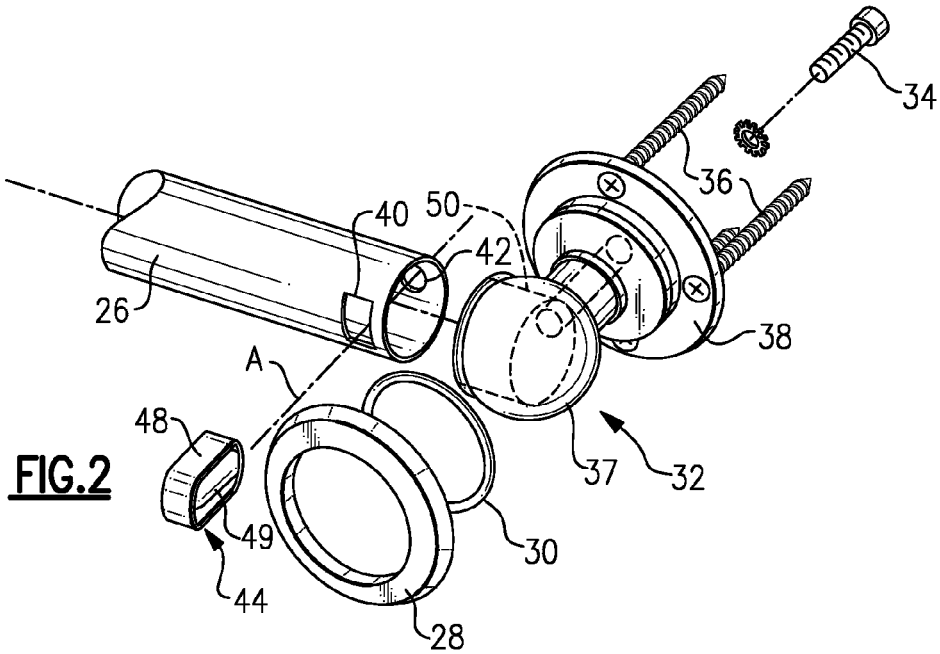
FIG. 2 is a general exploded view of the grab bar assembly of FIG. 1.

Referring to FIG. 2, the post assembly 22 generally includes a collar 28, a seal 30, a post 32, a bar fastener 34 and a multiple of post fasteners 36. The post 32 includes a receiver section 37 and a flange section 38. The receiver section 37 is closed to define a blind post which thereby alleviates the heretofore necessity of additional separate components such as an end cap or such like. The flange section 38 receives the multiple of post fasteners 36 to mount the post assembly 22 to a shower or tub wall.

The grab bar section 26 includes a first aperture 40 and a second aperture 42 which are defined along an axis A. The first aperture 40 is a non-circular aperture which corresponds to an insert 44 while the second aperture 42 may be a circular aperture to receive the bar fastener 34. The first aperture 40 may be oval, rectangular, square or other shape which permits passage of the insert 44 which corresponds therewith. That is, the insert 44 may pass through the first aperture 40 but not the second aperture 42.

The first aperture 40 receives the insert 44 to readily align the insert 44 along axis A. That is, the shape of the first aperture 40 facilitates alignment of the insert 44 with the second aperture 42. The insert 44 may include a boss 48 or such like which fits within the second aperture 42 to further align the insert 44 therewith. The insert 44 defines a length such that the insert 44 fits just flush with the grab bar section 26 yet provides a receptor 49 for fastener 34. Receptor 49 may include a threaded or self-threading section for fastener 34. The length of insert 44 facilitates alignment of the insert 44 within the grab bar section 26. That is, the insert cannot fall into the grab bar section 26 but remains in perfect alignment along axis A to receive fastener 34.

Once the insert 44 is passed through the first aperture 40 to abut the second aperture 42, the grab bar section 26 is inserted within an opening 50 within the receiver section 37. The bar fastener 34 is then passed through the flange section 38 and the receiver section 37 to be received into the insert 44 in a threaded relationship. The insert 44 thereby facilitates assembly of grab bars with a blind post assembly. The insert 44 also facilitates usage of a reduced wall thickness grab bar section yet maintains a significant load carrying ability.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit from the instant invention.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The disclosed embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A grab bar assembly comprising:

a grab bar having a first aperture and a second aperture defined along an axis;

a post which receives said grab bar;

an insert which passes through said first aperture and abuts said second aperture; and a fastener mounted through said post and said second aperture along said axis, said fastener receivable into said insert to retain said grab bar within said post.

2. The assembly as recited in claim 1, wherein said first aperture is rectilinear.

3. The assembly as recited in claim 1, wherein said second aperture is circular.

4. The assembly as recited in claim 1, wherein said grab bar is a substantially straight tubular member.

5. The assembly as recited in claim 1, wherein said post comprises a receiver section and a flange.

6. The assembly as recited in claim 5, wherein said receiver section includes an opening which receives said grab bar.

7. The assembly as recited in claim 1, wherein said fastener is threadable into said insert.

8. The grab bar assembly as recited in claim 1, wherein said insert defines a length along said axis to fit flush within said grab bar.

9. The grab bar assembly as recited in claim 8, wherein said insert defines a length along said axis equivalent to a diameter of said grab bar.

* * * * *